US005460461A

United States Patent [19]

McGrath

[11] Patent Number: 5,460,461

[45] Date of Patent: Oct. 24, 1995

[54] MANUAL CONCRETE SCREED HANDLE

[76] Inventor: Jim E. McGrath, 1713 Ridgemont, Wichita Falls, Tex. 76309

[21] Appl. No.: 231,463

[22] Filed: Apr. 22, 1994

[51] Int. Cl.[6] ..... E01C 19/44; B25B 1/20

[52] U.S. Cl. ..... 404/118; 269/6; 269/45; 269/71; 294/19.1

[58] Field of Search ..... 404/118; 269/3, 269/6, 45, 71, 228, DIG. 904; 81/177.2, 177.7, 487; 294/16, 19.1

[56] References Cited

U.S. PATENT DOCUMENTS

| | | | |
|---|---|---|---|
| 281,437 | 7/1883 | Bird | 81/331 |
| 2,793,065 | 5/1957 | McCurry | 294/16 |
| 3,253,850 | 5/1966 | Trusty | 294/16 |
| 3,645,577 | 2/1972 | Peper | 294/104 |
| 3,813,724 | 6/1974 | Unger | 294/104 X |
| 4,519,278 | 5/1985 | Heldt | 81/427.5 |
| 5,379,479 | 1/1995 | Nelson | 404/118 X |

*Primary Examiner*—David J. Bagnell

*Attorney, Agent, or Firm*—Dougherty, Hessin, Beavers & Gilbert

[57] ABSTRACT

A releasable screed handle for being operatively secured to a selected screeding member to manipulate the screeding member through the various spreading and smoothing motions requisite in working concrete. The screed handle consists of an elongated handle that is pivotally affixed, at an angle of about 105° from the vertical, to a lockable clamping plier that is capable of receiving and clamping a screed member of selected size and thickness.

6 Claims, 2 Drawing Sheets

MANUAL CONCRETE SCREED HANDLE

BACKGROUND OF THE INVENTION

1. Field of the Invention

The invention relates generally to a concrete screeding device and more particularly, but not by way of limitation, it relates to an improved hand screed implement that consists of a handle interconnected at a specific angular relationship to a clamping device adapted for holding a screed panel or plate.

2. Description of the Prior Art

The prior art has seen numerous types of devices which include a rapid clamping element in their necessary structure. A U.S. Pat. No. 3,253,850 teaches a carrying device that includes a pair of conventional vise grip pliers having a carrier handle attached. The device is useful in removing cans containing trees, bushes and shrubs from the ground as it provides what is essentially a quick release carrying implement. A recently issued U.S. Pat. No. 4,519,278 provides yet another teaching of a particular tool or implement that includes a vise-grip plier of conventional type within its combinative structure. Thus, the U.S. Pat. No. 4,519,278 consists of an elongate brace adapted for interlocking insertion into the handle of locking pliers thereby to allow the locking of pliers on a difficult-to-remove bolt, screw or the like in order to exert increased rotational force for removal. This device simply enables a greater and more controllable torque force to be applied to whatever the object seized by the plier implement.

SUMMARY OF THE INVENTION

The present invention relates to an improved type of manual screeding implement which consists of a handle having a quick-release gripping plier secured on one end thereof for the purpose of securing a screed, i.e., a board or plate, which may be used for moving and smoothing ready-mix concrete. The handle is affixed to the gripping member or screed holder at an angle of approximately 105°, an optimum angle for moving and smoothing the concrete in a most relaxed and least tiring manner.

Therefore, it is an object of the present invention to provide a manual concrete screed that is less stressful to the knees, lower back, arms, wrists and hands of the user.

It is also an object of the present invention to provide a screed clamp with handle that may be readily affixed in pairs on opposite ends of whatever sized screeding board that may be required.

It is still further an object of the invention to provide a screed clamping device that will maintain an optimum handle angle while moving concrete.

Finally, it is an object of the present invention to provide a screed clamp of the quick release type that is rugged and reliable in operation.

Other objects and advantages of the invention will be evident from the following detailed description when read in conjunction with the accompanying drawings which illustrate the invention.

DETAILED DESCRIPTION OF THE INVENTION

Figure 1:
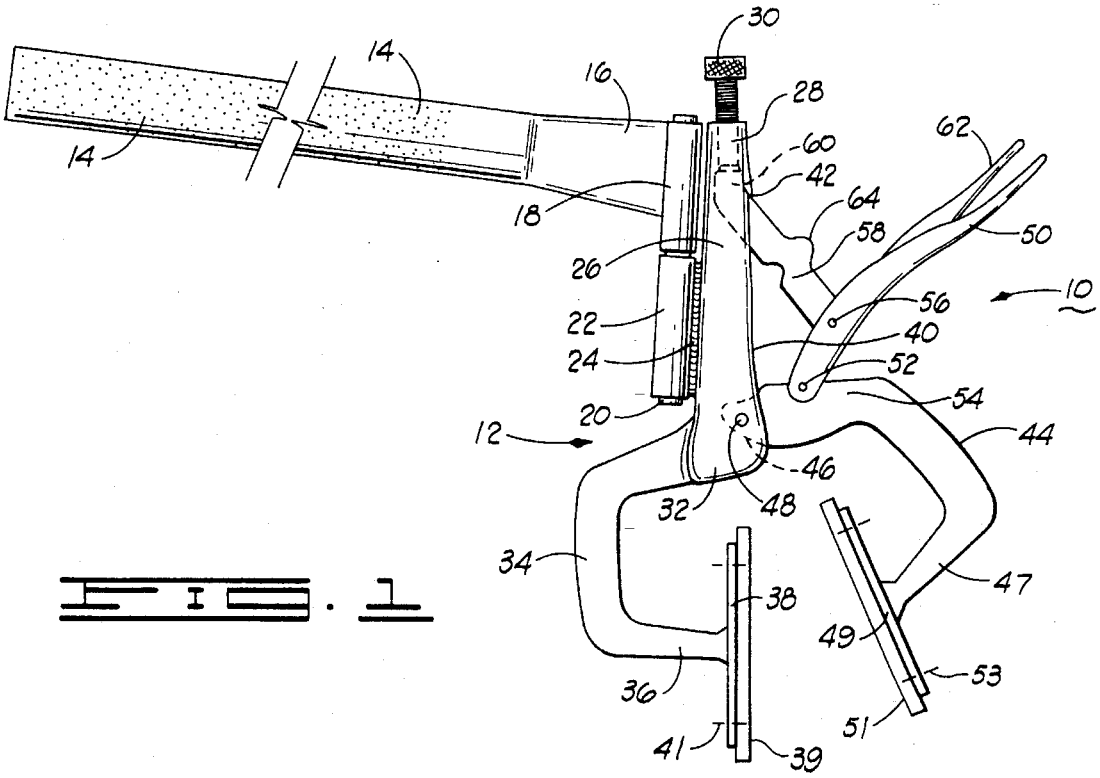
FIG. 1 is a side view in elevation of the screed clamp with handle of the present invention.

Referring to FIGS. 1–4, a screed handle 10 consists essentially of a vise grip clamp 12 swively affixed to one end of an elongated handle 14. The handle 14 is constructed of light weight metal pipe on the order of forty-two inches in length albeit that no particular length need be specified. An inner end 16 of pipe 14 is flattened for weldment affixture to a pintle member 18 that extends a pivot rod 20 for insertion in a sleeve 22. The pivot rod 20 is then pivotally retained in sleeve 22 by means of a retainer clip or the like. The handle 14 is preferably finished with a primer, sand and paint friction coating to enhance the gripping capability.

The sleeve 22 is secured as by weldment 24 along the edge of vise grip handle 26. The vise grip handle 26 includes an upper, internally threaded end 28 which receives an adjustment bolt 30 therein, and the lower end of handle 26 is formed into a right-angle bend 32 to extend a first clamp jaw 34 which terminates in jaw support 36. The jaw 34 takes a rectangular shape as it defines a relatively large space between handle bend 32 and jaw support 36. A first gripping plate 38 is then securely welded on jaw support 36 and generally in alignment with vise grip handle 26; however, it is important to note that the gripping plate 38 is secured so that it lies at an angle of approximately 105° relative to the handle 14. The 105° angle is a comfortable compromise suitable for most operators but a lesser angle may be desirable for a smaller operator having shorter arms. An elastomer pad 39, on the order of ¼ inch thickness, is fixed on gripping plate 38 by means of a plurality of spaced fasteners 41, e.g., recessed bolts, rivets or the like.

Figure 2:
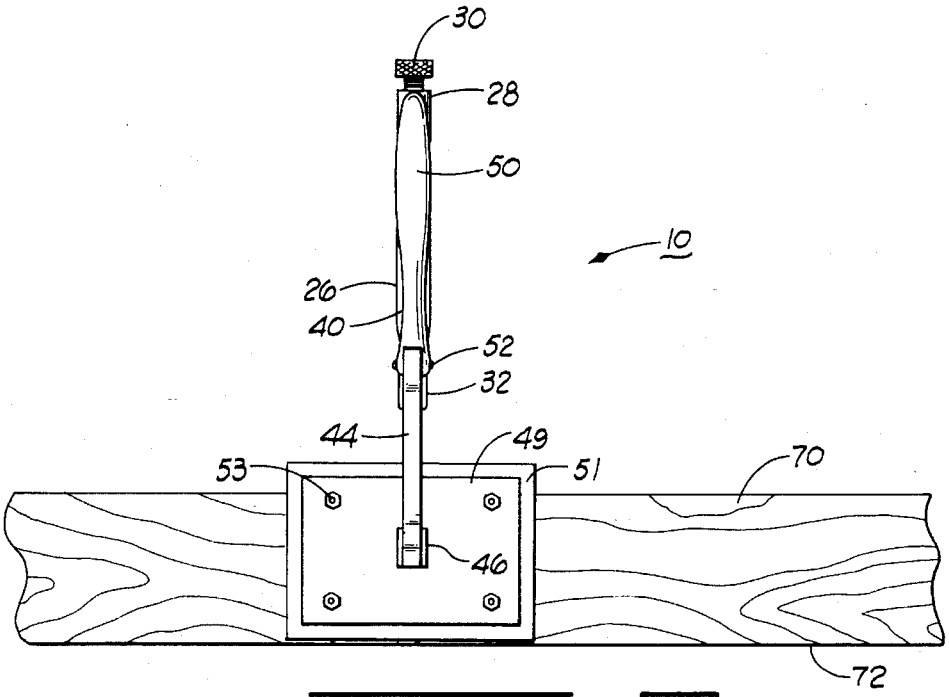
FIG. 2 is a front view in elevation of the screed clamp and a portion of screeding element.
Figure 4:
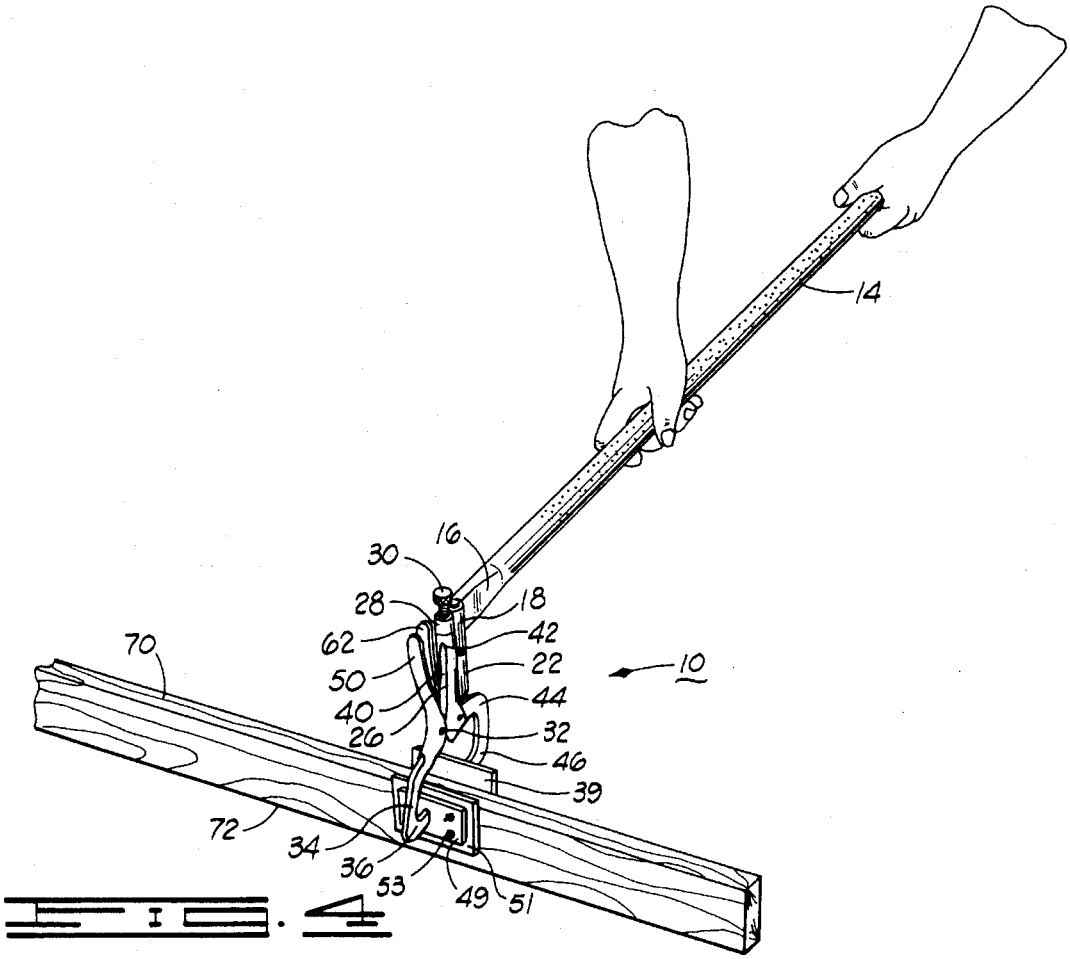
FIG. 4 is an operational view of the handle, clamp and screed in a front perspective view.

The lower part of vise grip handle 26 defines an open channel 40, shown in FIGS. 2 and 4, which extends from the handle lower end 32 to a shoulder 42 which also serves as the clamping lock brace. A second clamping jaw 44 is pivotally retained as a pivot end 46 is inserted in slot 40 into alignment with a pivot pin 48 for retention therein. The clamp jaw 44 is a mirror image of the opposite clamp jaw 34 and extends a clamp support 47 into the operative clamping area. A second gripping plate 49 is then weld secured on clamp support 47 for coaction with the opposite plate member, gripping plate 38, and an elastomer pad 51 is secured thereon by means of fasteners 53.

The vise grip clamp 12 is closed and locked in conventional vise grip manner. That is, an actuator handle 50 is pivotally affixed by pivot pin 52 at a pivot shoulder 54 proximate the pivot end 46 of clamp jaw 44. The actuator handle 50, a channel member, includes an intermediate pivot pin 56 pivotally securing a brace bar 58 within handle slot 40 (FIG. 2) adjacent shoulder 42. The brace end 60 is disposed against the inner end of adjustment bolt 30. Setting the adjustment bolt 30 adjusts the position of brace bar 58 and thereby the locking point spacing for gripping plates 38 and 49. When in the locked position, a release bar 62, also pivotally affixed within handle 50, coacts with a pawl 64 formed on brace bar 58 to enable initial release of the tightly closed vise grip handles 50 and 26.

Figure 3:
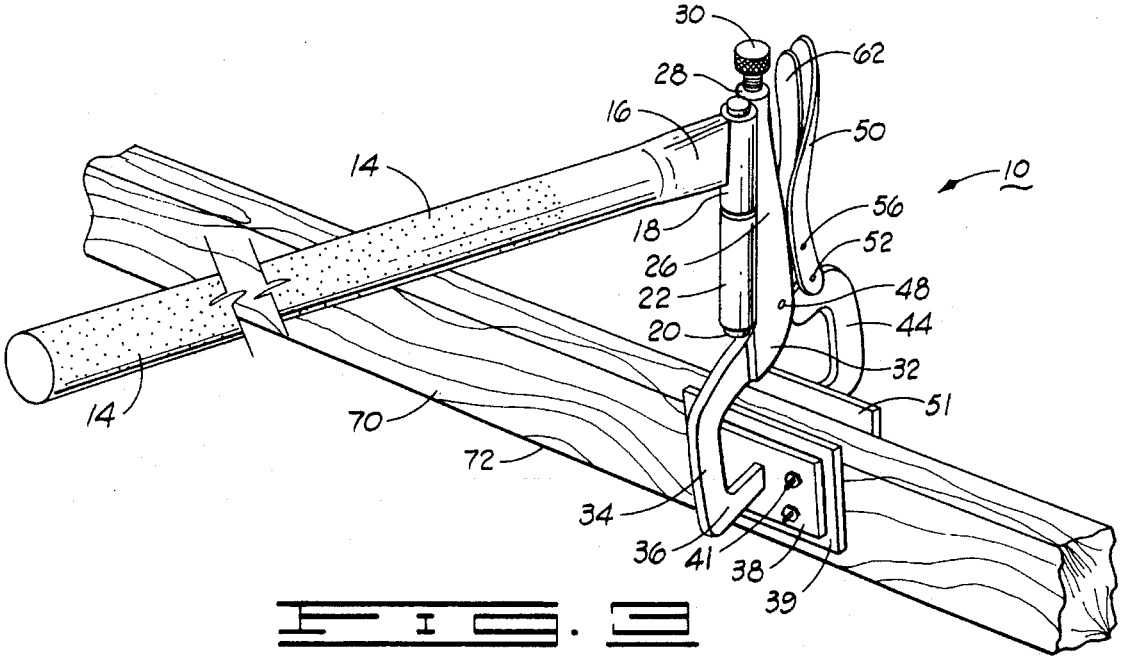
FIG. 3 is a perspective view from the rear quarter of a screed and clamping device with handle.

As shown in FIGS. 2, 3 and 4, a selected screed member 70 may be held between clamping plates 38 and 49, and respective pads 39 and 51, for use in moving and spreading previously poured ready-mix concrete. A lower straight edge 72 of screed member 70 is used for smoothing. Actually, two such screed handles 10 are employed usually, one by each of two men with each man or concrete finisher positioned at opposite ends of a long screed member which may vary in length from 10 to 20 feet, depending on the job layout and form disposition. The screed member 70 may be a board obtained at the work site such as a one by six of required length, although it is possible that some jobs may require a thicker screed member on the order of a two inch plank. The operator must keep in mind that this greatly increases the weight of the screed member and can make the smoothing operation more difficult. Also, the screed member 70 may be selected from commercially available types that are made of light-weight magnesium.

The screed handle 10 is used primarily by concrete finishers for the manual placement of concrete of the ready-mix type. A single concrete finisher might employ a single hand screed 10 as used with a screed member of nominal or shorter length for smaller jobs such as sidewalks and the like. However, most concrete placements about a work site will require a wider screed member, i.e., longer, with an individual screed handle 10 clamped on each side of an elongate screed member 70. The tool is designed to relieve the extreme stress of hand-working concrete in a bent-over position. It relieves stress to the knees, lower back, arms, wrists and hands thereby reducing the pain or tiredness of working in a stooped position for long periods of time. The operator is allowed to manipulate the screed member while standing in a more upright position thereby also enhancing visibility and accuracy of movement.

In operation, the concrete worker clamps his respective screed handle 10 to the screed member 70 and securely locks the clamping mechanism with clamping plates 38 and 49 seizing the screed member 70. This may require adjustment of the bolt 30 to adjust the angle at which brace bar 58 engages the actuator handle 50 thereby varying the space between plates 38 and 49. The operator then grasps the handle 14 in the manner shown in FIG. 4 to commence the screeding activity. The bulk concrete is first pulled down flat by applying pressure down on the front of the screed 70 and thereafter pulling backward in a rowing motion. The finisher then lifts the screed (while the handles stay attached) and repeats the motion for as many times as required to fully distribute and smooth the top surface of the concrete. The screed handle 10 may be used to make both vertical and horizontal motions since the handle 14 is connected to the vise grip clamp 12 by means of pintle member 18 and sleeve 22 which are pivotal around a vertical axis.

The foregoing discloses a novel form of screed handle that is capable of quick-release fastening at an operating position along a screed member. Two operators can employ two screed handles at widely spaced operating positions, such spacing being made in accordance with the exigencies of the operation. The screed handles employ a vise grip type of clamping plier that is capable of providing an extremely tight grip of the screed member while maintaining such grip through repeated screeding movements. The use of such screed handles enables the working of concrete with a minimum of wear and tear on the worker's knees, forearms and lower back as well as at other stress points.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A manual screed for distributing and smoothing concrete, comprising:

an elongated screed member of selected thickness having a flat screeding edge;

gripping means including first and second opposed clamping plates actuatable to seize and hold said screed member at a balanced position, said gripping means comprising a vice-grip type plier having a handle rigidly secured to a first jaw, a locking handle pivotally secured to a second jaw which, in turn, is pivotally secured to said handle adjacent said first jaw, said first and second jaws being secured to support said first and second opposed clamping plates; and an elongated handle secured to said gripping means and extending at an angle of approximately 105° from the plane of said first and second clamping plates when actuated.

2. A manual screed as set forth in claim 1 wherein said elongated handle comprises:

a pipe section of preselected length having first and second ends;

pivot means securing said pipe section to said gripping means so that the pipe section is pivotal therearound.

3. A removable handle for holding a screed member, comprising:

an elongated handle having first and second ends;

a clamp member having first and second clamping plates for holding said screed member; and pivot means securing said clamp member to said elongated handle second end at a predetermined angle greater than ninety degrees, said pivot means consisting of a pintle means secured to the second end of said elongated handle and extending a pivot rod generally transversely thereto, and a sleeve means secured to said clamp member for receiving said pivot pin in swivel affixture.

4. A removable handle as set forth in claim 3 wherein said clamp member comprises:

a clamp handle which extends a first clamp jaw into support of said first clamping plate at an angle of approximately 105° from said elongated handle;

a second clamp jaw pivotally affixed to said clamp handle and extending into support of said second clamping plate; and a locking handle pivotally affixed to said second clamp jaw and actuatable to close said second clamping plate toward said first clamping plate to a locked position.

5. A removable handle as set forth in claim 4 which further includes:

first and second elastomer pads secured on said first and second clamping plates for secure clamping against said screed member.

6. A removable handle as set forth in claim 4 which further includes:

adjustment means on said clamp handle for varying the space between the first and second clamping plates in the locked position.

* * * * *